United States Patent [19]

Kindelspire

[11] 4,233,732

[45] Nov. 18, 1980

[54] METHOD OF ASSEMBLING A RELAY DEVICE

[75] Inventor: Thomas J. Kindelspire, Morris, Ill.

[73] Assignee: General Electric Company, Fort Wayne, Ind.

[21] Appl. No.: 959,913

[22] Filed: Nov. 13, 1978

Related U.S. Application Data

[62] Division of Ser. No. 795,797, May 11, 1977, Pat. No. 4,158,828.

[51] Int. Cl.[3] ..... H01R 43/00

[52] U.S. Cl. ..... 29/881; 29/884

[58] Field of Search ..... 335/156, 202, 6; 29/602 R, 628, 630 B, 881, 884, 622; 339/208, 206 R, 207 R, 210 R

[56] References Cited

U.S. PATENT DOCUMENTS

| | | | |
|---|---|---|---|
| 3,130,284 | 4/1964 | Woods | 335/156 |
| 3,179,915 | 4/1965 | Klassen | 339/208 X |
| 3,287,675 | 11/1966 | Woods | 335/202 |
| 4,029,896 | 6/1977 | Skinner | 339/208 X |

*Primary Examiner*—Carl E. Hall

*Attorney, Agent, or Firm*—Joseph E. Papin

[57] ABSTRACT

A method of assembling a relay device adapted to be removably mounted in plug-on relation to male terminals. The relay device has a housing portion with a pair of cavities therein adapted to seat a pair of female terminals electrically connected to electrical leads in circuit means of the relay device. In this method, the female terminal pair are arranged with respect to the cavity pair so that the female terminal pair may be seated therein. A cover is releasably secured onto the housing portion in a predetermined assembled position to capture the female terminal pair in the cavity pair, and a pair of openings in the cover are disposed with respect to the cavity pair and the female terminal pair for accommodating the passage through the opening pair of the male terminal into electrical contacting engagement with the female terminal pair when the relay device is removably mounted in the plug-on relation with the male terminals.

1 Claim, 7 Drawing Figures

METHOD OF ASSEMBLING A RELAY DEVICE

CROSS-REFERENCE TO RELATED APPLICATION

This application is a division of application Ser. No. 795,797 filed May 11, 1977 (now U.S. Pat. No. 4,158,828 issued June 19, 1979) which is incorporated by reference herein.

Field of the Invention

This invention relates in general to electrical devices and in particular to a method of assembling such.

BACKGROUND OF THE INVENTION

In the past, relay devices have had a wide variety of applications with respect to various electrical energized apparatus. For example, an electric motor in a hermetic environment may, to avoid possible arcing within the hermetic environment, employ a relay device exteriorly of such environment with the relay device having normally open contacts in series with a start or auxiliary winding means of the electric motor and a relay coil in series with a run or main winding means means of the electric motor. Thus, upon initial energization of the electric motor, a large current is drawn through the main winding means causing the relay device to effect the closure of its contacts in order to energize the auxiliary winding means generally simultaneously with the energization of the main winding means of the electric motor. As the motor speed increases generally to a preselected value, the current draw of the main winding means is decreased, and the relay device drops out, i.e. effects the reopening of its contacts, thereby to disable or disconnect the auxiliary winding means or disconnect it from circuit relation with the main winding means. Of course, the continued energization of the main winding means thereafter operates the electric motor generally at its preselected or synchronous speed.

One relay device well suited to this type arrangement is illustrated in Woods U.S. Pat. No. 3,130,284. This patented relay device includes an insulating housing containing movable contacts and an axially movable sleeve which is mounted within the housing so as to be movable between two positions to actuate the contacts. A reciprocable magnetic armature is slidably mounted on the sleeve, and an electrical coil is disposed on the housing for magnetically energizing the armature. When a sufficient current is drawn through the coil, the armature is magnetically attracted against a spring force to move the sleeve and drive the contacts to their closed position. When the current drawn through the coil drops below a specified or drop-out level, the magnetic field of the coil is correspondingly reduced, and the spring force overcomes the reduced magnetic attraction of the coil with respect to the armature driving it against the sleeve to effect the reopening of the contacts. This relay device is mechanically mounted to a cooperating supporting structure by a generally U-shaped bracket having a pair of depending legs for grippingly receiving the relay device, and an integral base is formed between such leg to receive screws or the like which threadedly engage such cooperating supporting structure.

A plug-on relay device is disclosed in a later Lee O. Woods U.S. Pat. No. 3,287,675 in which female terminals are disposed in a portion of the relay device housing for receiving in electrical contacting engagement male terminals when the relay device is plugged into such male terminals. In this arrangement, the male terminals are predeterminately mounted so as to be connected in circuit relation with a winding circuit of an electric motor which may be disposed in a hermetic environment. Still another plug-on type relay device is disclosed in a copending Lee O. Woods U.S. patent application Ser. No. 809,054 filed June 22, 1977 (now U.S. Pat. No. 4,175,260 issued Nov. 20, 1979).

SUMMARY OF THE INVENTION

Among the several objects of the present invention may be noted the provision of an improved method of assembling a relay device; the provision of such method employing separate housing portions defining a terminal receptacle and which are assembled together by integral releasable securing means; the provision of such method in which female terminals are captured between the housing portions in their assembled positions; the provision of such method in which the female terminals are predeterminately seated by confronting parts of the housing portions in their assembled positions so as to at least limit displacement movement of the female terminals within the relay device; and the provision of such method in which the components utilized therein are simplistic in design, easily assembled and economically manufactured. These as well as other objects and advantageous features of the present invention will be in part apparent and in part pointed out hereinafter.

In general and in one form of the invention, a method is provided for assembling a relay device adapted to be releasably mounted in plug-on relation with a pair of male terminals. The relay device has a housing portion with a pair of cavities therein adapted to seat a pair of female terminals which are electrically connected to electrical leads in the circuitry of the relay device. In this method the female terminals are arranged with respect to the cavities so that the female terminal may be seated therein. A cover is releasably secured onto the housing portion in an assembled position to capture the female terminal in the cavities, and a pair of openings in the cover are disposed with respect to the cavities and the female terminals for the passage through the openings of the male terminals into electrical contacting engagement with the female terminals when the relay device is releasably mounted in the plug-on relation with the male terminals.

BRIEF DESCRIPTION OF THE DRAWINGS

Corresponding reference characters indicate corresponding parts throughout the several views of the drawings.

The exemplifications set out herein illustrate a preferred embodiment of the invention in one form thereof, and such exemplifications are not to be construed as limiting the scope of the disclosure or the scope of the invention in any manner.

DETAILED DESCRIPTION OF THE PREFERRED EMBODIMENTS

Figure 7:
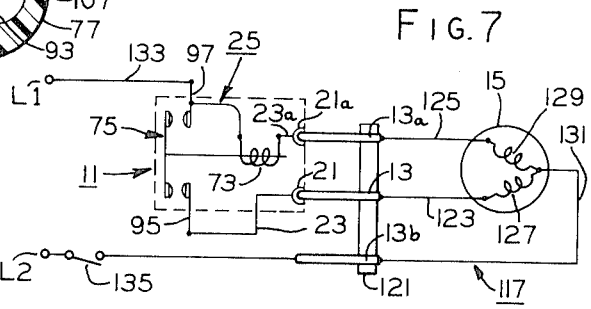
FIG. 7 is an exemplary schematic diagram of an electrical circuit in which the relay device of FIG. 1 may be utilized.
Figure 2:
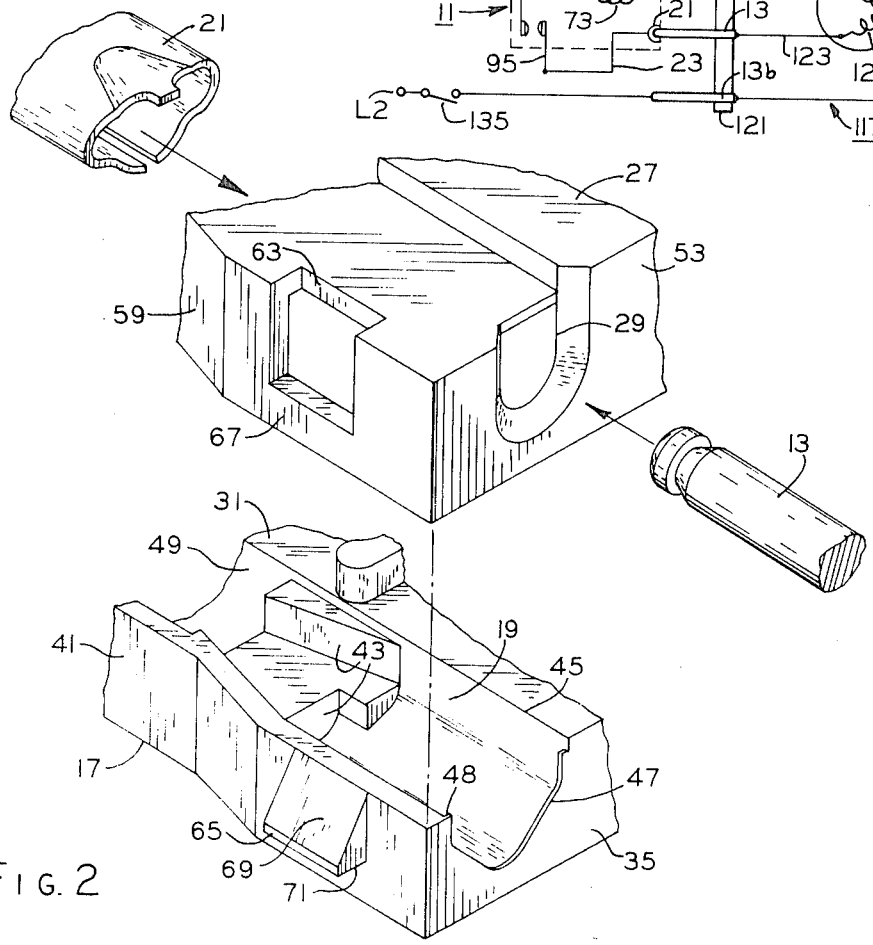
FIG. 2 is an exploded partial perspective view of a receptacle means of the relay device of FIG. 1 teaching principles which may be utilized in a method of assembling a relay device in one form of the invention.
Figure 3:
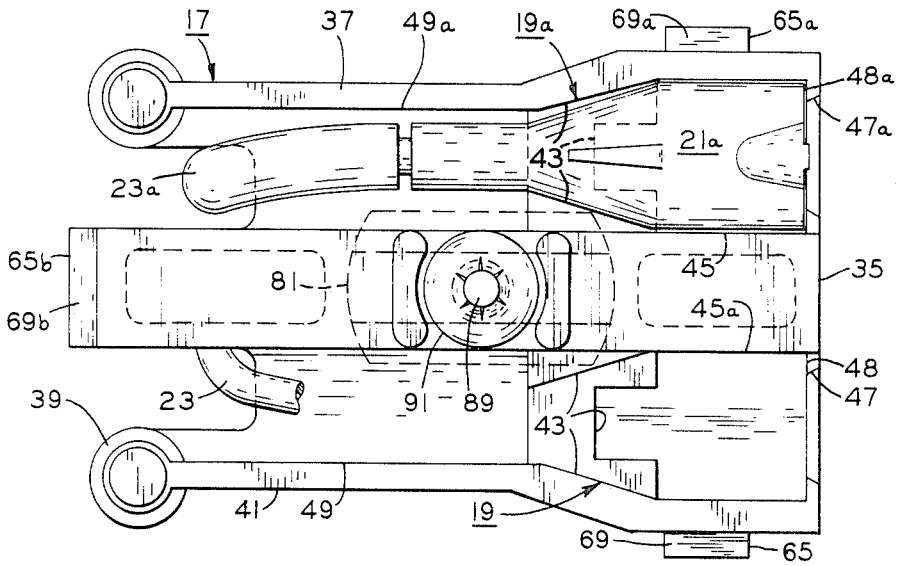
FIG. 3 is a partial top elevational view of the relay device of FIG. 1 illustrating the receptacle means with a cover portion thereof removed to illustrate the seating of female terminals within cavities provided therefor in the receptacle means.
Figure 4:
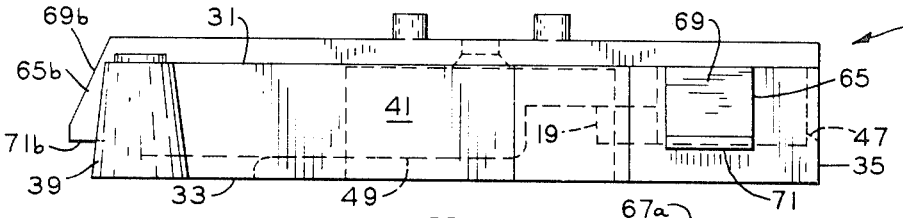
FIG. 4 is a side elevation of the portion of the receptacle means shown in FIG. 3.
Figure 5:
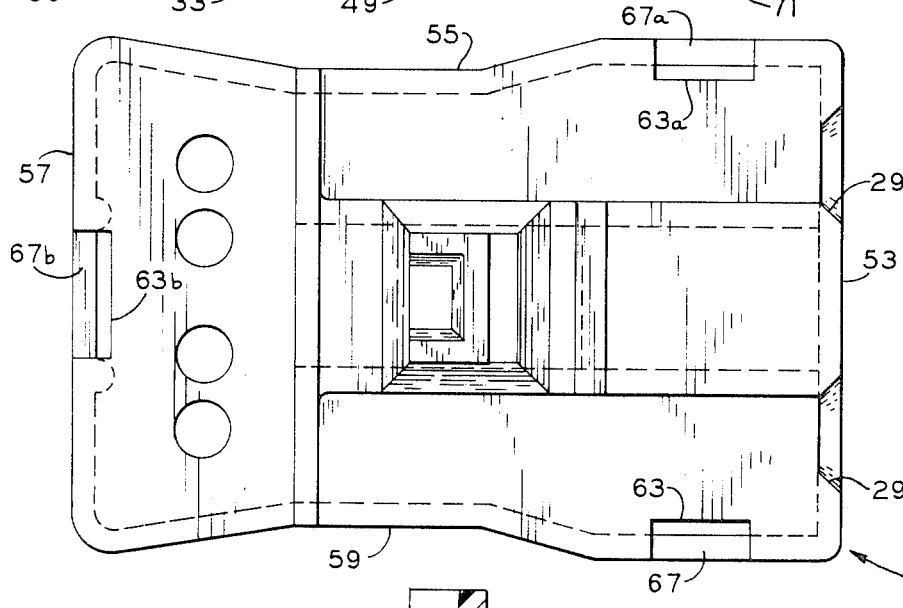
FIG. 5 is a plan view of the cover portion of the receptacle means.
Figure 6:
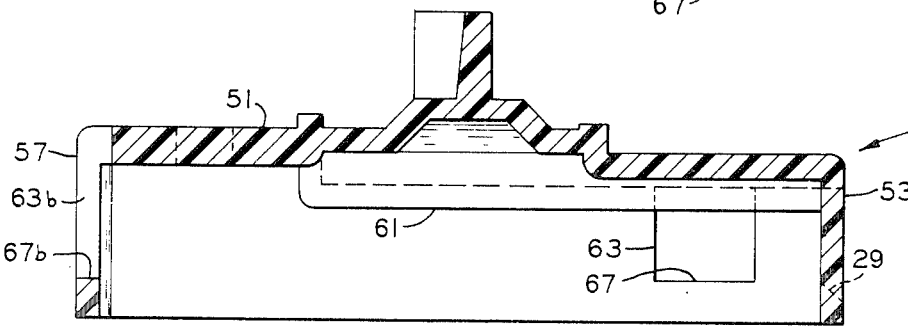
FIG. 6 is a side elevational view of the cover portion of FIG. 5.

Referring now to the drawings in general, a method is provided in one form of the invention for assembling a relay device 11 adapted to be releasably or removably mounted in plug-on relation with male terminals 13, 13*a* of an electrically energized apparatus, such as a prime mover or electric motor 15 for instance (FIG. 7). Relay device 11 has a housing or flange portion 17 with a pair of cavities, such as chambers, receiving means or pockets 19, 19*a*, therein adapted to seat or otherwise receive a pair of female terminals 21, 21*a* electrically connected to electrical leads or lead parts 23, 23*a* in circuit means 25 of the relay device (FIGS. 2, 3 and 7). In this assembling method, female terminals 21, 21*a* are arranged, placed or otherwise disposed with respect to cavities 19, 19*a* so that the female terminals may be seated therein (FIGS. 2 and 3). A cover or cover portion 27 is releasably secured to flange 17 in a predetermined assembled or assembly position to capture female terminals 21, 21*a* in cavities 19, 19*a*, and a pair of openings 29, 29*a* in the cover are disposed, positioned or otherwise located with respect to the cavities and the female terminals for accommodating the passage through the openings of male terminals 13, 13*a* into electrical contacting engagement with the female terminals when relay device 11 is removably mounted in the plug-on relation with the male terminals (FIGS. 2, 5 and 7).

More particularly and with specific reference to FIGS. 2–6, flange 17 and cover 27 are respectively molded or otherwise formed from a material having good electrical insulating characteristics, such as for instance a resin material or plastic or the like, and which is yieldable or resilient at least to a preselected degree. However, it is contemplated that only one of flange 17 and cover 27 may be formed of the aforementioned yieldable or deformable material within the scope of the invention so as to meet the objects and advantages features thereof. Flange 17 has a pair of generally opposite or upper and lower surfaces 31, 33 interconnected or intersecting between a plurality of side surfaces 35, 37, 39, 41, and cavities 19, 19*a* are provided in the flange generally in spaced apart side-by-side relation intersecting with upper surface 31 and side surface 35. A pair of means, such as seats or abutments 43, 43*a*, for seating or seating engagement with female terminals 21, 21*a* are provided in cavities 19, 19*a*, and a pair of slots or groove portions 45, 45*a* extend from the seats in one direction toward side surface 35 terminating in a pair of apertures 47, 47*a* which intersect with the side surface. Another pair of means, such as seats or shoulders 48, 48*a*, for seating engagement with female terminals 21, 21*a* are also provided in cavities 19, 19*a* extending between slots 45, 45*a* and apertures 47, 47*a*. Thus, cavities 19, 19*a* compromise seats 43, 43*a*, slots 45, 45*a*, apertures 47, 47*a* and shoulders 48, 48*a* with the seats, slots and shoulders adapted to engage or seat confronting parts of female terminals 21, 21*a*, respectively. Lead guides, such as passage means or passages 49, 49*a*, which receive lead parts 23, 23*a* electrically connected to female terminals 21, 21*a*, are associated or connected with cavities 19, 19*a* extending therefrom in a direction generally opposite to that of slots 45, 45*a*, i.e. toward side surface 39, and the passage means intersect with upper and lower surfaces 31, 33 and side surface 39. Cover 27 has a cover wall 51 interconnected or intersecting between a plurality of depending sidewalls 53, 55, 57, 59, and openings or apertures 29, 29*a* and predeterminately positioned through sidewall 53 so as to generally align with female terminals 21, 21*a* seated in cavities 19, 19*a* and apertures 47, 47*a* thereof when the cover and flanges are in their predetermined assembled positions.

With female terminals 21, 21*a* and lead parts 23, 23*a* respectively positioned in cavities 19, 19*a* and passage means 49, 49*a* as previously mentioned, sidewalls 53–59 of cover 27 may be located or generally aligned so as to at least in part overlay in opposed confronting relation side surfaces 35–41 of flange 17. Of course, with sidewalls 53–59 so located with respect to side surfaces 35–41, cover wall 51 is spaced from upper surface 31 of flange 17 generally in overlaying relation therewith. At least one of flange 17 and cover 27 is thereafter moved with respect to the other thereof into their predetermined assembled position so as to dispose cover wall 51 at least closely adjacent upper surface 31 of the flange thereby to effect the closure of cavities 19, 19*a* and passage means 49, 49*a* capturing or enclosing female terminals 21, 21*a* and lead parts 23, 23*a* therein, respectively. Upon such movement of flange 17 and cover 27 to the predetermined assembled position thereof, engagement means, such as abutments 61, 61*a*, on cover wall 51 may be disposed in abutting or locating engagement with confronting parts of female terminals 21, 21*a* so as to at least limit displacement movement of the female terminals with respect to seats 43, 43*a* and shoulders 48, 48*a* in cavities 19, 19*a*. Further, it may be noted that the displacement movement in cavities 19, 19*a* of female terminals 21, 21*a* is also at least limited by the engagement of the female terminals between their seats 43, 43*a* and shoulders 48, 48*a* of the cavities.

As flange 17 and cover 27 are being assembled in their predetermined assembled position, a plurality of recess or detent means, such as opeings 63, 63*a*, 63*b* for instance, provided in sidewalls 59, 55, 57 of the cover are received over or otherwise passed a plurality of latches or latching means 65, 65*a*, 65*b* integrally provided on side surfaces 41, 37, 39 of the flange so as to be releasably engaged or secured therewith, and with the detent means and recess means so cooperatively associated with each other, the cover and flange are releasably maintained against displacement from their predetermined assembled position. In other words when flange 17 and cover 27 are moved toward their predetermined assembled positions, a part of a plurality of leading or distal edges or edge portions 67, 67*a*, 67*b* of sidewalls 55, 59, 57 adjacent or in the vicinity of recess means 63, 63*a*, 63*b* are engaged with a plurality of sloped surfaces 69, 69*a*, 69*b* of latching means 65, 65*a*, 65*b*, and in response to the wedging action of this engagement, sidewalls 55, 59, 57 yield or are spread slightly apart generally in opposite directions to accommodate the passage of the sidewall edges over the sloped surfaces. Of course, when sidewall edges 67, 67*a*, 67*b* pass over sloped surfaces 69, 69*a*, 69*b*, the resiliency of sidewalls 55, 59, 57 cause them to resile or regain their original shape generally snapping the edge portions 67, 67*a*, 67*b* into releasable holding or securing engagement with a plurality of lower holding or latching shoulders or catches 71, 71*a*, 71*b* on latching means 65, 65*a*, 65*b* so that the latching means protrude into the recess means so as to be captured thereby. Thus, recess means 63, 63*a*, 63*b* and latches 65, 65*a*, 65*b* comprise sets of means for releasable engagement with each other so as to maintain flange 17 and cover 27 in their predetermined assembled position. While recess means 63, 63*a*, 63*b* and latching means 65, 65*a*, 65*b* are illustrated herein as being respectively integral with cover 27 and flange 17, it is contemplated that the recess means might be integral with the flange with the latching means being integral with the cover or that both the cover and the flange may be provided with each of the recess means and the detent means within the scope of the invention so as to meet the objects and advantageous features thereof. Further, while three cooperatively associated recess means 63, 63*a*, 63*b* and latching means 65, 65*a*, 65*b* are illustrated herein for purposes of disclosure, it is also contemplated that a greater or lesser number of such cooperating associated recess means and detent means may be utilized within the scope of the invention so as to meet the objects and advantageous features thereof.

Figure 1:
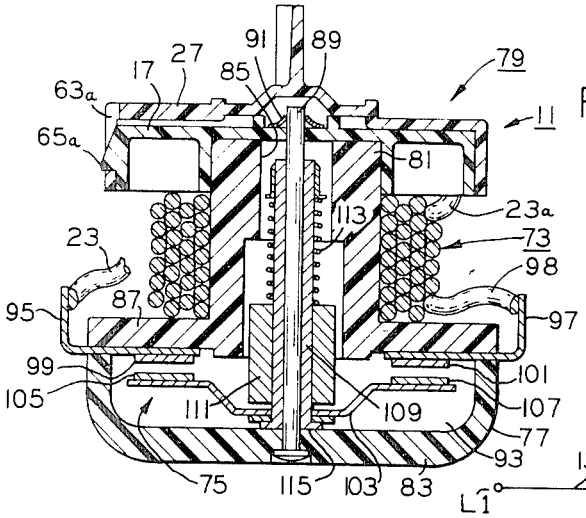
FIG. 1 is a sectional view illustrating a relay device.

Referring again in general to the drawings and recapitulating at least in part with respect to the foregoing, relay device 11 is adapted to be removably mounted in plug-on circuit relation with male terminal pair 13, 13*a* of electric motor 15 (FIG. 7). Relay device 11 is provided with coil means 73 adapted for electrical energization, and means, indicated generally at 75, is arranged in magnetic coupling relation with the coil means and operable generally for switching between circuit completing and interrupting positions (FIG. 1). Female terminals 21, 21*a* are connected in circuit relation with coil means 73 and switching means 75, and the female terminals are adapted for receiving in electrical contacting engagement male terminals 13, 13*a* (FIGS. 1, 2 and 7). Means, indicated generally at 77, is provided for housing coil means 73 and switching means 75, and the housing means includes a plug-on terminal receptacle or receptacle means 79 for the removable mounting in the plug-on relation with male terminals 13, 13*a* with the receptacle means generally being comprised by flange 17 and cover 27 (FIG. 1). Flange 17 has cavities 19, 19*a* for respectively receiving in seated positions therein female terminals 21, 21*a*, and cover 27 is separable from the flange and disposed in the predetermined assembled position therewith so as to capture the female terminals generally in the seated positions thereof in the cavities (FIGS. 1–3 and 5). Openings 29, 29*a* in cover 27 communicate with cavities 19, 19*a* and are generally aligned with the female terminals captured in the seated positions thereof in the cavities for accommodating the passage of male terminals 13, 13*a* into the electrical contacting engagement with the female terminals upon the removable mounting of receptacle means with the male terminal means (FIGS. 2, 3, 5 and 7). A plurality of means, such as recess means 63, 63*a*, 63*b* and latching means 65, 65*a*, 65*b*, are respectively integral with cover 27 and flange 17 and are cooperatively associated with each other for releasably maintaining the cover against displacement from its predetermined assembled position on the flange (FIGS. 2, 3 and 5).

More particularly and with specific reference to FIGS. 1, 3 and 5, housing means or housing 77 has a plurality of housing portions or ports including flange 17, cover 27, a bobbin 81 and a closure member 83, and the bobbin and closure member may also be molded or otherwise formed from a suitable dielectric material. Bobbin 81 has a bore 85 extending between the opposite ends thereof, and an integral base 87 extends generally radially of the bobbin adjacent one of the opposite ends thereof. A headed pin 89 extending through bobbin bore 85, closure member 83 and flange 17 retains the closure member seated on bobbin base 87 and retains the flange seated on the other end of bobbin 81, and a jam nut or washer 91 or the like is fixedly connected between the pin and the flange thereby to retain the flange and closure member against displacement from the bobbin. Thus, flange 17, bobbin 81 and closure member 83 enclosure or define a switching means operating chamber 93 which includes bobbin bore 85, and a pair of terminals 95, 97 mounted between bobbin base 87 and closure member 83 have ends extending interiorly and exteriorly of the switch means chamber.

Coil means or relay coil 73 comprises a plurality of turns of dielectrically coated wire wound about bobbin 81 between base 87 thereof and flange 17, and one end or lead part 23*a* of the turn plurality is connected by suitable means, such as soldering or crimping for instance, with female terminal 21*a* while the other end or lead part 98 of the turn plurality is connected by suitable means, such as soldering for instance, to the exterior end of terminal 97. Lead 23 which is connected by suitable means, such as soldering or crimping or the like to female terminal 21, as previously mentioned, also has an end extending exteriorly of receptacle means 79 and connected by suitable means, such as soldering or the like, to the exterior end of terminal 95.

Switching means 75 comprises a pair of contacts 99, 101 mounted to the interior end of terminals 95, 97 in chamber 93, and a bridge 103 carries another pair of contacts 105, 107 adapted for making and breaking engagement with contacts 99, 101. Bridge 103 is carried adjacent the lower end of a sleeve 109 slidably movable on pin 89, and an armature means 111 is slidably received about the sleeve and predeterminately positioned so as to be magnetically coupled with coil means 73 upon the energization thereof. Resilient means, such as a coil spring 113, is caged between armature means or armature 111 and the upper end of sleeve 109. Thus in the at-rest position of switching means 75, the weight of armature means 111 acting on bridge 103 urges it into abutment with a hub 115 on the lower end of sleeve 109 and also urges the hub into engagement with closure member 83.

After the component parts of relay device 11 are assembled together as described above, lead parts 23, 23*a* may be led into or laid in passage means 49, 49*a* of flange 17 so that female terminals 21, 21*a* are disposed in cavities 19, 19*a* in seating engagement therein between seats 43, 3*a* and shoulders 48, 48*a*, as shown in FIG. 3. With female terminals 21, 21*a* and leads 23, 23*a* so located in flange 17, cover 27 may be disposed generally about the flange in the assembled positions thereof wherein recess means 63, 63*a*, 63*b* of the cover and latching means 65, 65*a*, 65*b* of the flange are releasably engaged so as to maintain the cover and the flange in their predetermined assembled positions, as previously described hereinabove.

Thus, when cover 27 is releasably secured to flange 17 to complete the assembly of relay device 11, receptacle means 79 may be removably mounted in plug-on circuit relation with male terminals 13, 13*a*, as illustrated in FIGS. 2 and 7, by passing openings 29, 29*a* in the receptacle means over the male terminals and inserting female terminals 21, 21*a* captured within cavities 19, 19*a* of the receptacle means into electrical contacting engagement with the male terminals.

Referring now to an exemplary circuit 117 shown in FIG. 7, male terminals 13, 13*a* and a third male terminal 13*b* may be mounted in a Fusite plug 121, if desired, on apparatus, such as a compressor for instance (not shown) having an hermetic environment in which electric motor 15 operates. Of course, male terminals 13, 13*a*, 13*b* may also be mounted in various other manners well-known to the art on supporting structure (not shown) which may be associated with electric motor 15 within the scope of the invention so as to meet the objects and advantageous features thereof. Male terminals 13, 13*a* are respectively connected by leads 123, 125 with auxiliary or start winding means 127 and main or run winding means 129 of electric motor 15, and a return lead 131 interconnects the auxiliary and main winding means through male terminal 13*b* to a power terminal L2 which represents one side of a power source L1, L2. To complete the exemplary circuit, another lead 133 is connected between power terminal L1 and the external end of terminal 97 in relay device 11, and an on-off type switch 135 may be interconnected in lead 131 (or lead 133 if desired) for controlling the energization of electric motor 15 across power source L1, L2.

In the operation of relay device 11 in circuit 117 with the components thereof in their at-rest positions as shown in the drawings and described hereinabove, an operator may close on-off switch 135 to effect the energization of electric motor 15 across power source L1, L2. With on-off switch 135 closed, current may flow from power terminal L1 through lead 133, relay device terminal 97, coil means 73, female terminal 21*a*, male terminal 13*a*, lead 125 to main winding means 129 of electric motor 15 and therefrom through return lead 131, male terminal 13*b* and closed switch 135 to power terminal L2. Of course, upon such initial energization of electric motor 15, there is a rather heavy current draw by its main winding means, and coil means 73 of relay device is responsive to such current draw to produce a magnetic field coupling with armature means 111 causing it to throw or rise (as best seen in FIG. 1) upwardly against the compressive force of spring 113. Of course, the force exerted by the rising movement of armature means 111 against spring 113 is transmitted therethrough to sleeve 109, and the sleeve rises on pin 89 generally conjointly with the rise of the armature means. In this manner, bridge 103 is moved upwardly with sleeve 109 until contacts 105, 107 on the bridge are moved into a circuit completing position in making engagement with contacts 99, 101. When contacts 105, 107 are made with contacts 99, 101, current flows from relay device terminal 97 through bridge 103 to terminal 95 and therefrom through lead 23, female terminal 21, male terminal 13 and lead 123 to effect the energization or excitation of auxiliary winding means 127 generally simultaneously with the above described excitation of main winding means 129. As electric motor 15 is energized by auxiliary and main winding means 127, 129 generally to a preselected or synchronous speed, the current draw is appreciably reduced effecting a corresponding reduction of the intensity of the magnetic field produced by coil means 73 in response to the reduced current draw. Therefore, when the current draw attains a preselected low or drop-out value for relay device 11, the magnetic coupling between coil means 73 and armature means 111 of the relay device is insufficient to hold the armature means against the compressive force of spring 113 acting thereon. Thus, the compressive force of spring 113 drives armature means 111 in a downward direction (as best seen in FIG. 1) so as to strike a hammer-like blow to bridge 103 causing it to move contacts 105, 107 from contacts 99, 101 in a very positive manner, and thereafter spring 113 drives the armature means, the bridge and sleeve 109 toward their at-rest or circuit interrupting positions, as previously described. Of course, upon the breaking of contacts 105, 107 from contacts 99, 101, circuit means 25 of relay device 11 is opened therethrough so as to effect the de-excitation of auxiliary winding means 127 of electric motor 15, and the electric motor may be thereafter energized generally at its synchronous speed in response to the excitation of main winding means 127 thereof. If a more detailed description of the operation of relay device 11 is desired reference may be had to the Lee O. Woods U.S. Pat. No. 3,130,284.

From the foregoing, it is now apparent that a novel method of assembling a relay device has been presented meeting the objects and advantageous features set out hereinabove, as well as others, and that modifications as to the precise configurations, shapes, details and connections of the relay device, as well as the precise steps of the method, may be made by those having ordinary skill in the art without departing from the spirit of the invention or the scope thereof as set out by the claims which follow.

I claim:

1. A method of assembling a relay device having a flange portion and a cover portion adapted to be releasably secured together in a preselected assembly position and with at least the cover portion formed from a material having a resilient characteristic, the flange portion including a generally planar upper surface interconnected between a plurality of side surfaces depending therefrom, a pair of opposite facing latches on a pair of opposite side surfaces of the side surface plurality, and a pair of female terminal receiving cavities extending into the upper surface and intersecting with another one of the side surfaces of the side surface plurality interposed between the opposite side surface pair thereby to define therethrough a pair of intersections, respectively, the cover portion including a generally planar cover wall interconnected between a plurality of sidewalls depending therefrom, a pair of latch receiving openings in a pair of opposite sidewalls of the sidewall plurality and a pair of uninterrupted cavity communicating apertures in another one of the sidewalls of the sidewall plurality interposed between the sidewall pair, the method comprising the steps of:

placing a pair of female terminals in the cavities therefor of the upper surface and disposing a female electrical connector section of the female terminals at least adjacent the intersection pair for communication therewith, respectively;

initially overlapping in opposed at least adjacent relation only distal portions of the sidewalls with confronting portions of the side surfaces so that the cover wall is arranged in spaced apart generally parallel planar relation with the upper surface and aligning with the opening pair and the aperture pair in spaced relation with and generally above the wedge pair and the intersection pair thereby to place the cover portion and the flange portion in a preselected preassembly position prior to the releasable securing thereof on the preselected assembly position, respectively;

applying an assembly force onto at least one of the cover portion and the flange portion so as to displace them from the preassembly position toward the assembly position thereof;

moving in response to the applied assembly force the cover wall in a direction generally perpendicular toward the upper surface so as to maintain the generally parallel planar relation therebetween;

wedging the opposite sidewall pair at least in the vicinity adjacent the opening pair therein into engagement with the latch pair on the opposite side surface pair and spreading apart the opposite sidewall pair in the at least vicinity adjacent the opening pair therein in opposite directions generally away from the confronting portions of the opposite side surface pair respectively in the overlapping relation therewith at least generally simultaneously with the moving step;

then passing the opening pair in the opposite sidewall pair over the latch pair on the opposite side surface pair while the opposite sidewall pair are spread apart and moving the aperture pair in the another one sidewall generally into aligned overlapping relation with the intersection pair in the another one side surface so as to communicate therethrough with the female electrical connector sections of the female terminal pair in the cavity pair, respectively; and resiling the spread apart opposite sidewall pair in a return direction toward the opposite side surface pair thereby to place the sidewalls of the cover portion in overlapping relation at least adjacent the confronting side surfaces of the flange and releasably securing thereby the cover portion and the flange portion in the preselected assembly position thereof with the female terminal pair captured in the cavity pair between the upper surface and the cover wall in the generally parallel relation thereof.

* * * * *